US009739069B2

(12) United States Patent
Jiang et al.

(10) Patent No.: US 9,739,069 B2
(45) Date of Patent: Aug. 22, 2017

(54) METHODS OF ASSEMBLING COOLING TOWERS

(71) Applicant: SPX COOLING TECHNOLOGIES, INC., Overland Park, KS (US)

(72) Inventors: Hongjun Jiang, Leawood, KS (US); Andjelko Piskuric, Overland Park, KS (US)

(73) Assignee: SPX COOLING TECHNOLOGIES, INC., Overland Park, KS (US)

( * ) Notice: Subject to any disclaimer, the term of this patent is extended or adjusted under 35 U.S.C. 154(b) by 0 days.

(21) Appl. No.: 14/789,253

(22) Filed: Jul. 1, 2015

(65) Prior Publication Data

US 2017/0002583 A1 Jan. 5, 2017

(51) Int. Cl.
*E04H 5/12* (2006.01)

(52) U.S. Cl.
CPC ..... *E04H 5/12* (2013.01)

(58) Field of Classification Search
CPC ..... Y10T 29/49359; F28D 2021/0028; F28D 2021/0061; F28D 2021/0068; F28D 2021/0082
USPC ..... 52/143, 745.03
See application file for complete search history.

(56) References Cited

U.S. PATENT DOCUMENTS 5,851,446 A * 12/1998 Bardo ..... E04H 5/12 261/111
8,602,397 B2 * 12/2013 Daley ..... F28F 25/02 165/174
2003/0085476 A1 * 5/2003 Kinney, Jr. ..... F28C 1/00 261/109
2004/0228699 A1 * 11/2004 Venton-Walters ... B61D 45/001 410/109
2010/0326641 A1 * 12/2010 Kaiser ..... F24H 1/0027 165/157
2014/0192395 A1 7/2014 Kothari
2014/0264971 A1 9/2014 Powell et al.
2015/0130092 A1 5/2015 Powell

* cited by examiner

*Primary Examiner* — Brian Glessner
*Assistant Examiner* — Adam Barlow
(74) *Attorney, Agent, or Firm* — Baker and Hostetler LLP

(57) ABSTRACT

The present disclosure relates to modules for heat exchange for use in cooling towers and methods of assembling cooling towers using such modules. The aforementioned modules for heat exchange may include fill packing and a structural system configured to provide support for at least the fill packing, in which the structural system includes a plurality of structural members configured to provide compression and tension support. The aforementioned modules for heat exchange may be assembled prior to being transported to a job site and installed in a cooling tower. A method for assembling a cooling tower using the aforementioned modules for heat exchange includes: constructing a cold water basin; assembling an air inlet structure on the cold water basin; and placing a heat exchange module on top of the air inlet structure.

19 Claims, 12 Drawing Sheets

METHODS OF ASSEMBLING COOLING TOWERS

FIELD OF THE INVENTION

The present disclosure relates generally to modules for heat exchange for use in cooling towers. The present disclosure also relates to methods of assembling cooling towers using modules for heat exchange. More particularly, the present disclosure relates, for example, to fill layer modules that can be pre-assembled in a factory setting and transported to a job site and installed in a cooling tower.

BACKGROUND OF THE INVENTION

Cooling towers are heat exchangers of a type widely used to emanate low grade heat into the atmosphere and are typically utilized in electricity generation, air conditioning installations, and the like. These towers receive a relatively warm or hot fluid, and pass the fluid through the tower apparatus so that heat is extracted from the fluid by interaction with relatively cooler ambient air.

Cooling towers generally include counter-flow type cooling towers and cross-flow type cooling towers. In a counter-flow cooling tower, liquid of high temperature is cooled as it flows downwards through fill or packing and is brought into contact with air traveling upwards. Conversely, in a cross-flow cooling tower, liquid of high temperature is cooled with air that moves horizontally through the fill or packing.

A drawback associated with current cooling towers is that they are typically very labor intensive in their assembly at the job site. The assembly of such towers oftentimes requires a dedicated labor force investing a large amount of hours. Accordingly, such assembly is labor intensive requiring a large amount of time and therefore can be costly. Uncertainties such as weather and site conditions may also affect the time required to assemble cooling towers at a job site. The quality of the labor force may also lead to quality and performance issues associated with the towers. Thus, it is desirable to assemble as much of the tower structure at the manufacturing plant or facility, prior to shipping it to the installation site.

But while it may be desirable to assemble tower components at a factory, conventional designs for cooling towers oftentimes necessitate their assembly at a job site. For example, factors such as the size of the various tower components and their structural strength may limit their ability to be manufactured at the factory and transported onsite.

Therefore, it is desirable to have a cooling tower that is assembled using components that can be manufactured in a factory and transported to a job site.

SUMMARY OF THE INVENTION

Embodiments of the present disclosure advantageously provides for a module cooling tower and methods for assembling such a cooling tower. These methods can be applied to counter-flow or cross-flow cooling towers.

An embodiment of the disclosure is a heat exchange module for use in a cooling tower comprising: fill packing; and a structural system configured to provide support for at least the fill packing, in which the structural system includes a plurality of structural members configured to provide compression and tension support.

Another embodiment is a heat exchange module for use in a cooling tower comprising: fill packing; and a triangular support structure comprising a plurality of structural members, in which the heat exchange module is configured to be transportable, and the triangular support structure is configured to provide support for the heat exchange module when the heat exchange module is transported.

Another embodiment is a heat exchange module for use in a cooling tower comprising: fill packing; and a firewall structure, in which the heat exchange module is configured to be transportable, and the firewall structure is configured to withstand dynamic loads when the heat exchange module is transported.

Another embodiment is a method for assembling a cooling tower, the method comprising the steps of: assembling a heat exchange module, the heat exchange module comprising fill packing and a structural system; placing the heat exchange module when assembled on a carrier; and transporting the carrier to a site of the cooling tower.

Another embodiment is a method for assembling a cooling tower, the method comprising the steps of: constructing a cold water basin; assembling an air inlet structure on the cold water basin; and placing a heat exchange module on top of the air inlet structure, in which the heat exchange module is assembled prior to being placed on top of the air inlet structure and comprises fill packing and a structural system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above-mentioned and other features and advantages of this disclosure, and the manner of attaining them, will become more apparent and the disclosure itself will be better understood by reference to the following description of various embodiments of the disclosure taken in conjunction with the accompanying figures.

DETAILED DESCRIPTION OF THE INVENTION

Figure 1:
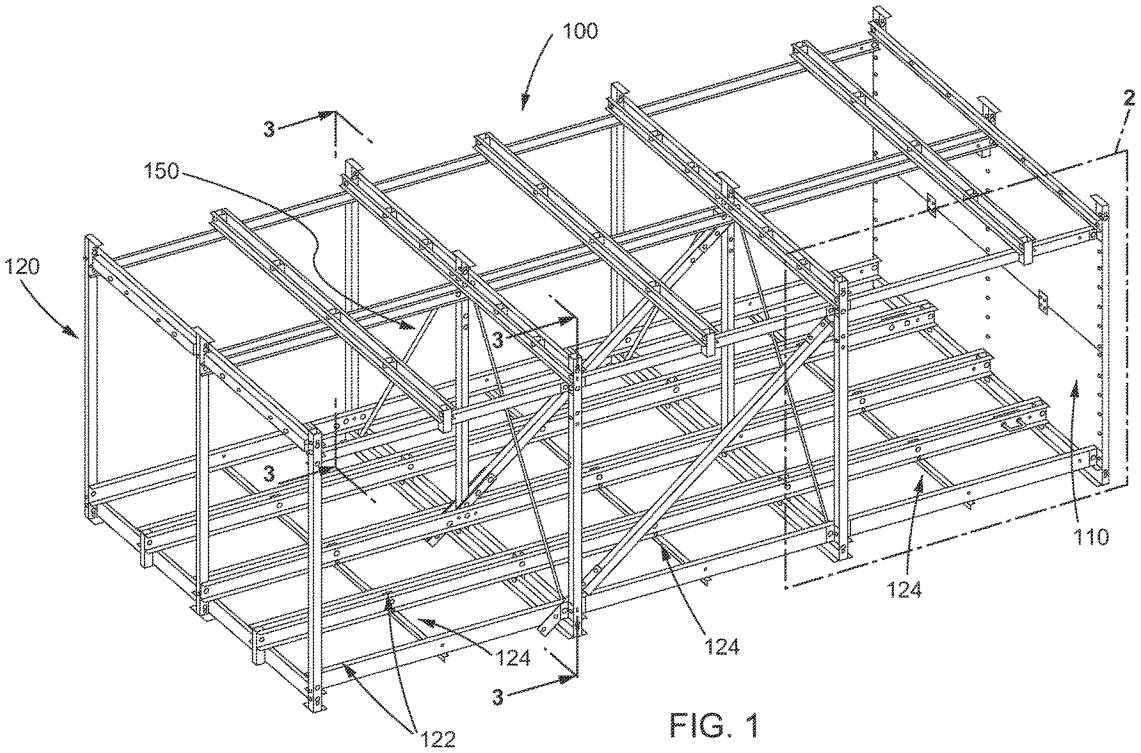
FIG. 1 is a perspective view of a heat exchange module structure in accordance with an embodiment of the present disclosure.

In the following detailed description, reference is made to the accompanying drawings, which form a part hereof and show by way of illustration specific embodiments in which the invention may be practiced. These embodiments are described in sufficient detail to enable those skilled in the art to practice them, and it is to be understood that other embodiments may be utilized, and that structural, logical, processing, and electrical changes may be made. It should be appreciated that any list of materials or arrangements of elements is for example purposes only and is by no means intended to be exhaustive. The progression of processing steps described is an example; however, the sequence of steps is not limited to that set forth herein and may be changed as is known in the art, with the exception of steps necessarily occurring in a certain order.

Cooling towers regulate the temperature of relatively warm or hot fluid by passing the fluid through a tower apparatus that brings it into contact with relatively cooler ambient air. These towers typically include a hot liquid distribution system. Examples of these distribution systems may have a series of water distribution nozzles or an apertured distribution basin or the like, and a cold water collection basin positioned at the base or bottom of the cooling tower. Commonly, a splash-type water dispersing fill structure is disposed in the space between the hot water distribution system and the underlying cold water collection basin. The aforementioned fill structure oftentimes includes either a plurality of elongated, horizontally arranged and staggered splash bars supported at spaced intervals by an upright grid structure or frame assembly, or a series of fill packs or fill packing composed of a number of film fill sheets. During assembly of the evaporative cooling towers, typically, an outer shell or support structure is built first and then a rack or grid support is affixed to the support shell. Splash bars are then threaded into the rack. The splash bars generally provide a surface for consistent, predictable dispersal and breakup of the water droplets over a range of water loadings typically encountered during operation of the evaporative cooling tower. Typically, these splash bars are long and thin and the fill structure includes a great number of them. Alternatively, during assembly, fill packs may be employed and installed into the support structure of the cooling tower.

In a counter-flow tower, the liquid to be cooled is pumped in and distributed over the fill structure so that air which is drawn in from below serves to cool the liquid being distributed through the fill structure. These towers typically include an air inlet region that is disposed below the fill layer for drawing in the ambient air, and a plenum chamber above the fill layer for receiving the air after it travels through the fill layer. The air is then released into the atmosphere via a fan located at the top of the cooling tower. In a cross-flow tower, the liquid to be cooled is again distributed over the fill structure but is met with air that moves horizontally through the fill structure. Similar to the counter-flow tower, the cross-flow tower has an air inlet region which generally corresponds to the height of the fill structure and a plenum chamber.

Systems and methods disclosed herein provide a cooling tower having an air inlet structure, a fill module including the fill structure, and a plenum module. Various components of the air inlet structure, fill module, and plenum module may be pre-assembled in a factory prior to being installed in the cooling tower. These components may be adapted to be easily handled for transportation and quick assembly at a job site. Thus, systems and methods disclosed herein provide a process for constructing a cooling tower using pre-assembled modular components.

In systems and methods disclosed herein, the fill module may be preassembled in a factory. The fill module may be an example of a heat exchange module. The fill module may include fill packs or splash fill packing and a supporting structure. As described above, the fill packs or splash fill packing comprise film fill packing. The fill packs are notched at the factory so that the structure can be packaged around the fill packs. The fill modules are then aligned with one another using alignment tubes prior to transportation to a job site. The fill modules may be transported by loading them onto flatbed trailers using a special forklift. The fill modules may be secured to the flatbed trailers with tie-down members such as, for example, a U-shaped bolt. When the fill modules arrive at the job site, the modules may be hoisted from the trailer using a specially designed lift fixture and placed directly onto a structure such as an air inlet structure which has been pre-assembled at the job site. The fill module may then be aligned and connected to surrounding structure using specially designed corbels.

Systems and methods disclosed herein also provide a structural system for a fill module for transporting the assembled fill module to a job site. Fill layers in conventional cooling towers typically comprise a fiberglass structure which lacks sufficient bending strength to withstand transportation. Thus, to overcome this problem, systems and methods disclosed herein provide for a structural system with sufficient flexural and tensile strength to withstand dynamic loads during transportation.

Moreover, systems and methods disclosed herein provide a global structural system for a cooling tower having solid structural members at every elevation of the tower or, specifically, in the air inlet structure, the fill module, and plenum module or structure. Conventional cooling towers that are constructed at a job site typically have a supporting structure comprising tension/compression hard diagonals. Fill structure designs, however, that are inserted into such cooling towers do not incorporate permanent primary structure as a part of its design. Moreover, many conventional cooling towers comprise tension-only supporting members such as, for example, small rods or thin straps. The tension-only members provide little to no compressive resistance and therefore buckle under compression loads. While these tension-only members may be smaller than tension/compression members, these tension-only members are not permitted in some structural applications, particularly in seismic applications.

Accordingly, systems and methods disclosed herein provide a global structural system that is designed in three different portions—specifically, a first portion in an air inlet structure, a second portion in a fill module, and a third portion in a plenum module or structure. In particular, such systems and methods provide a structural frame for a fill module that forms a portion of the permanent tower system. Each portion of the structural system is designed to withstand its own heaviest load combination. In other words, each portion of the structural system is designed to take into account the portions above it that transmit loads to the lower portions.

Moreover, systems and methods disclosed herein provide a structural system having a king post design for supporting the fill module during transportation. The structural system may include tension-only diagonals that are disposed symmetrically about a central tension/compression member or "king post." When the fill module is transported, the bottom of the fill module may sit on a flatbed of a truck having a width less than the width of the fill module. Accordingly, if the fill module is centered on the flatbed, two portions of the fill module may overhang the sides of the flatbed. Such portions may be referred to as the "overhang portions." The tension-only diagonals of the structural system may carry loads from the overhang portions of the fill module to the top of the king post, and the king post may deliver a compressive force downward towards the middle of the module at the center of the truck. Without the tension-only diagonals, the size of the horizontal members may need to be increased in order to carry the load of the fill module overhanging the flatbed truck during transportation. Increasing the size of these horizontal members may be costly and also add to the weight of transportation. In comparison, the tension-only diagonals are relatively inexpensive. Accordingly, systems and methods disclosed herein provide a less costly solution for transporting a fill module to a job site.

Systems and methods disclosed herein also provide a fill module that is ready or nearly ready for installation into a cooling tower when it arrives as a job site. In specific applications, systems and methods may provide a fill module that can be hoisted from a carrier and installed in a cooling tower within fifteen (15) to thirty (30) minutes.

Systems and methods disclosed herein also provide a fill module comprising a height less than a conventional fill layer of a cooling tower. In particular, a typical fill layer including, for example, a MC75 counter-flow film fill of five (5) feet may be eight (8) feet and four (4) inches. Other examples of fill may include a DF254 counter-flow film fill of five (5) feet and four (4) inches, or a MVC20 counter-flow film fill of four (4) feet and eight (8) inches. Systems and methods disclosed herein may provide a fill module including fill with the same height but having an overall module height of seven (7) feet and two (2) inches.

Systems and methods disclosed herein also provide corbels designed with alignment holes that can be used to connect various structures of the cooling tower to one another. For example, such systems and methods may provide a corbel that is designed to connect a fill module with an air inlet structure. In conventional cooling towers, column splices may occur between the different stories or levels of the tower. Spliced columns may be undesirable because the splice is perceived as not being as structurally sound as a continuous column and raises concerns about the bearing of one column on top of another column if they are misaligned. To avoid these problems, systems and methods disclosed herein connect the various structures of a cooling tower to one another using corbels. Such systems and methods may connect the various structures to one another at a girt line or horizontal structural member, further adding to the strength of the overall structure.

Systems and methods disclosed herein also provide a fill module having bottom girts arranged such that a layer of transverse girts are disposed below a layer of longitudinal girts. Such an arrangement allows for a lifting fork to be easily inserted along the bottom of the fill module from its side. In particular, the lifting fork may be inserted along the base of the fill module with the forks parallel to the transverse girts and in contact with the longitudinal girts. Because the fill module is adapted to allow the fork to be directly inserted below its bottom base, the fill module may be transported without a wood pallet or the like, which reduces the cost and time of transportation. Accordingly, such systems and methods disclosed herein provide a fill module adapted for more efficient transportation to a job site.

Systems and methods disclosed herein also provide a fill module having top girts arranged such that a layer of transverse girts are disposed above a layer of longitudinal girts. Such an arrangement may provide elevation for a water distribution system positioned above the fill module. The added elevation may provide additional vertical space for the nozzles of the water distribution system to distribute the water over the fill packing within the fill modules.

Systems and methods disclosed herein also provide a fill module having a firewall adapted for transportation. The firewall may be pre-installed in the fill module prior to being transported to a job site. Unlike conventional firewall structures formed of fiber-reinforced cement that may be too brittle to withstand dynamic movements during transportation, the firewall disclosed herein may be formed of a fire-resistant fiber-reinforced polymer that has sufficient flexural and tensile strength to withstand transportation forces. The firewall may include fewer seams than a conventional firewall, thereby providing stronger fire resistance. The firewall disclosed herein may have a smooth, non-porous surface that reduces water absorption and in turn reduces product expansion. Because the firewall is designed to be pre-installed in the fill module prior to arriving at the job site, such systems and methods disclosed herein also reduces the amount of time required for field installation of the firewall.

Systems and methods disclosed herein also provide a fill module with a saddle assembly for supporting a header pipe or other distribution pipe of the water distribution system. The saddle assembly allows the header pipes to be installed in the cooling tower after the fill modules are installed. Specifically, the header pipes may be installed by being directly placed on top of the fill modules. Such an advantage may not be present in conventional cooling towers, which typically require the additional installation of a header pipe support beam and a sling upon which to hang the header pipe.

In addition, systems and methods disclosed herein provide an air inlet structure having kitted components such as kitted structural members. "Kitted" means that the components required to build a sub-structure of the air inlet structure are packaged together. Such packaging allows for easier sorting, gathering, and staging of materials for constructing the air inlet structure and thus reduces on-site assembly time and costs. Moreover, such systems and methods may provide an air inlet structure with certain preassembled components such as, for example, certain transverse bents (e.g., diagonal structural members). Such preassembly may further reduce the cost of on-site assembly by, for example, reducing the cost of labor needed to construct and erect the air inlet structure. Such preassembly may also reduce the cost of renting the equipment needed for erecting the air inlet structure.

Systems and methods disclosed herein also provide a cooling tower having components that are transported using a lesser number of trucks than a conventional cooling tower. Specifically, for example, such systems and methods provide fill modules that incorporate the tower structure with the fill unlike conventional fill layers that ship the structure and the fill separately. Thus, such systems and methods request less space for transport. Such systems and methods may also provide a firewall structure integrated into the fill modules that negates separate shipping of the firewall materials and therefore also requires less trucks for transport.

Turning now to FIG. 1, an exemplary fill module 100 is depicted. The fill module 100 may be an example of a heat exchange module. The fill module 100 may be assembled prior to being installed in a cooling tower. The fill module 100 may include fill packing (not depicted), a firewall 110, and a structural system 120. The structural system 120 of the fill module 100 may comprise a plurality of structural members. The plurality of structural members may include tension members capable of bearing a tension load and compression members capable of bearing a compression load. The tension members may be, for example, a thin rod or a strap. The compression members may be pultruded fiber-reinforced polymer tubes, concrete beams, steel beams, or another rigid support structure. For illustration purposes, in FIG. 1, the tension members of the structural system 120 are depicted as thin rods having a cross-sectional area less than the compression members. Some structural members of the plurality may be arranged longitudinally along a length of the fill module 100 (e.g., the longitudinal structural members 122), and some structural members of the plurality may be arranged along a length of the fill module 100 (e.g., the transverse structural members 124). In addition, certain structural members may be arranged as diagonals along one or more cross-sections of the fill module 100.

The fill module 100 is configured to be transportable. In particular, the fill module 100 may include certain components that are designed to allow the fill module 100 to be transported under typical transport conditions. For example, the structural system 120 of the fill module 100 may be configured to provide structural support for the fill module 100 when the fill module 100 is being transported. As described above, the structural system 120 may include tension members and compression members that can withstand various tension and compression loads when the fill module 100 is being transported.

Figure 2:
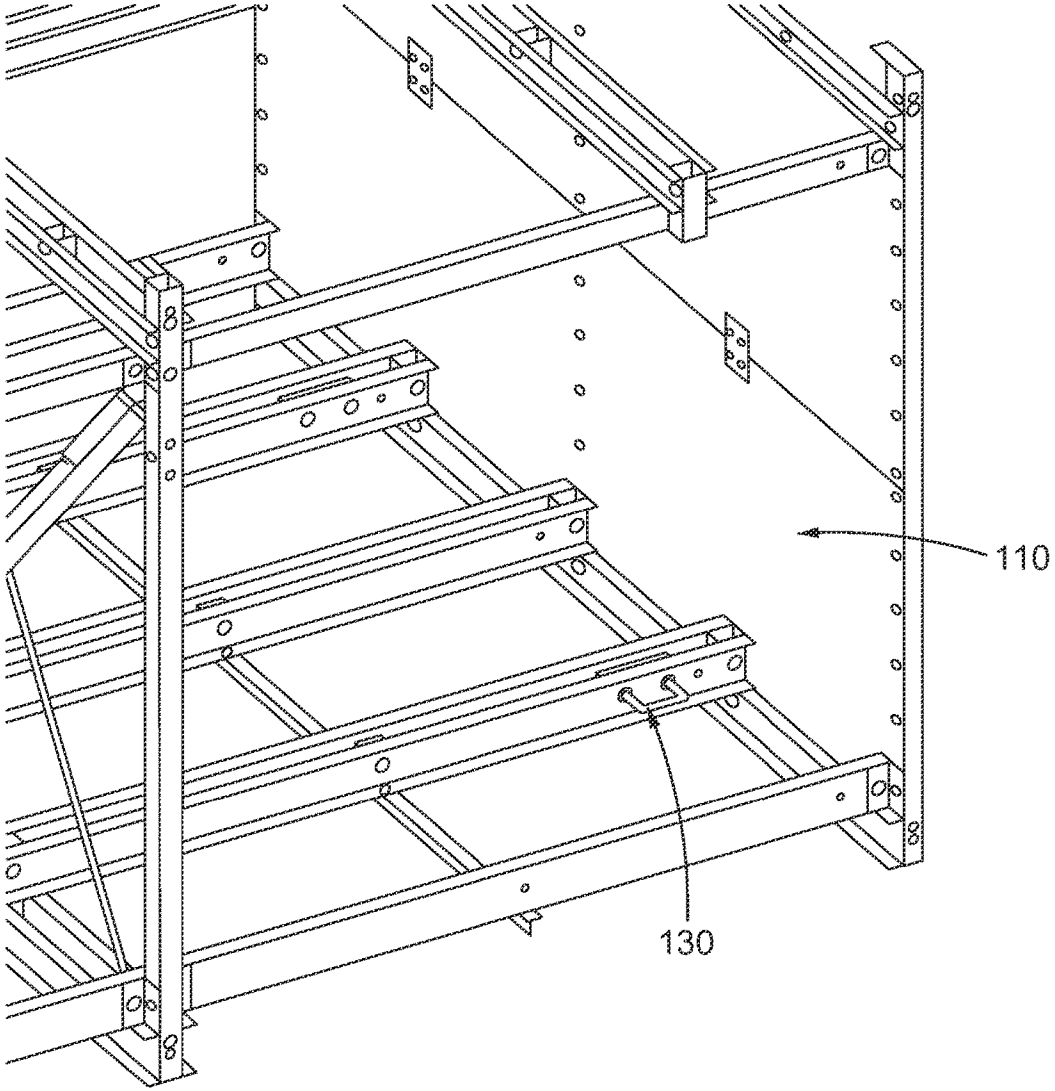
FIG. 2 is an enlarged perspective view of a side corner of the heat exchange module depicted in FIG. 1 in accordance with an embodiment of the present disclosure.

In addition, the fill module 100 may include a fastening member such as a U-shaped bolt 130, as depicted in FIG. 2. FIG. 2 provides a close-up view of a front right corner of the fill module 100 or, specifically, the outlined area 2 in FIG. 1. As shown in FIG. 2, the fill module 100 includes the U-shaped bolt 130. The U-shaped bolt 130 may be designed to fasten the fill module 100 to a portion of a carrier on which the fill module 100 is transported. For example, when the fill module 100 is transported on a flatbed of a truck, the U-shaped bolt 130 can be used to tie the fill module 100 to the flatbed of the truck. The U-shaped bolt 130 may be located proximate to an end of the fill module 100 with the firewall 110. Such placement may reduce the amount of movement that the firewall 110 may experience during transportation of the fill module 110. Alternatively, the U-shaped bolt 130 may be located at any convenient point along or proximate to the bottom base of the fill module 100.

Figure 12:
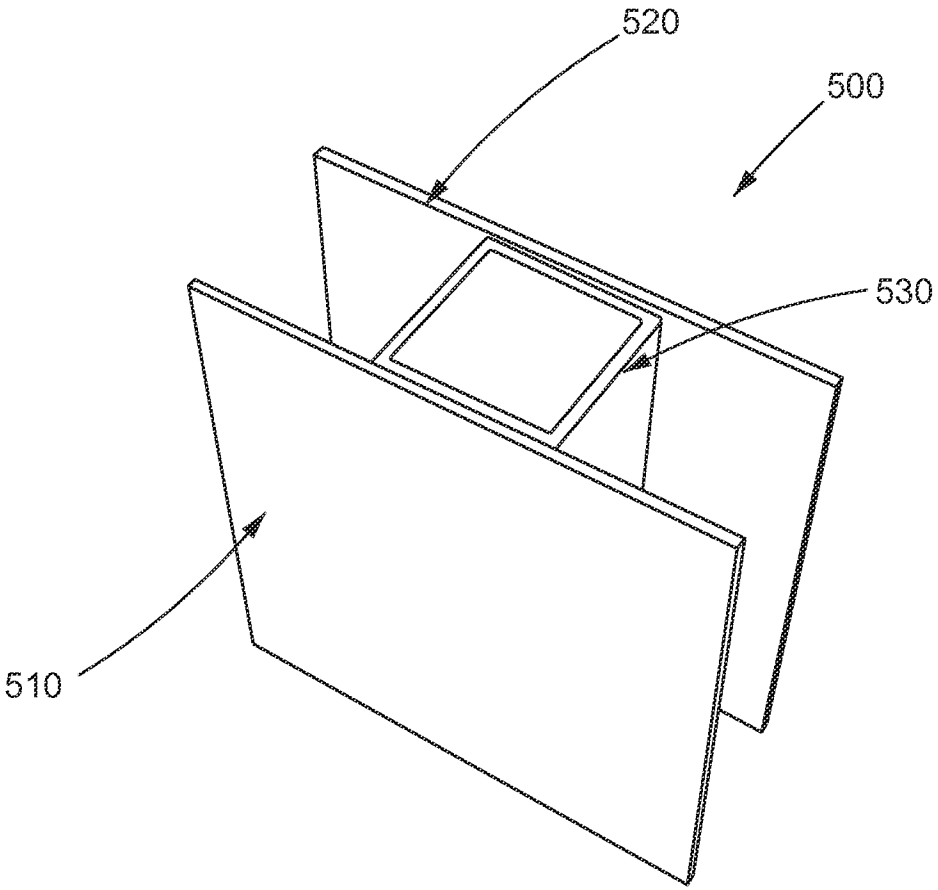
FIG. 12 is a schematic view of a firewall structure of a cooling tower in accordance with an embodiment of the present disclosure.

The firewall 110 of the fill module 100 may also be configured to be transportable. For example, the firewall 110 may be formed of a material with sufficient flexural or bending strength and sufficient tensile strength to withstand any dynamic movements of the fill module 100 during transportation. FIG. 12, described below, provides additional detail regarding a firewall structure of a fill module.

Figure 3:
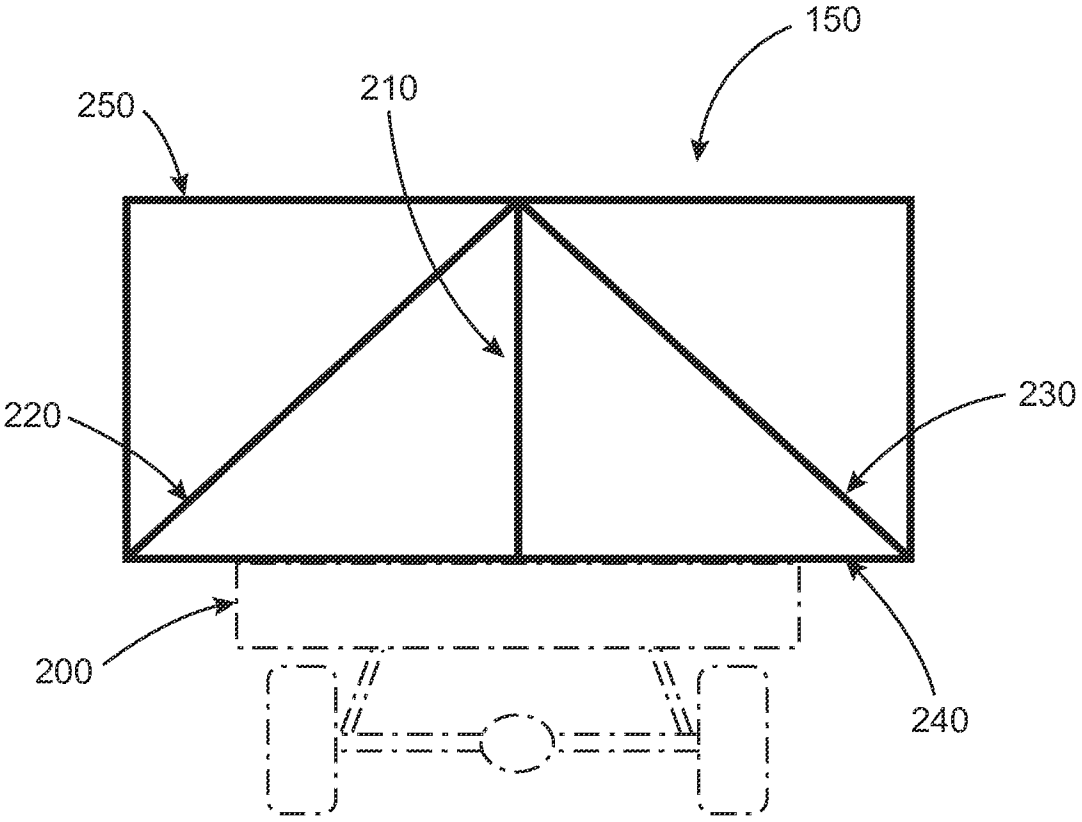
FIG. 3 is a schematic cross-sectional view of the heat exchange module depicted in FIG. 1 showing a triangular support structure in accordance with an embodiment of the present disclosure.

The fill module 100 may also include a structural component such as a triangular support structure for supporting the fill packing and other portions of the fill module 100 when the fill module 100 is being transported. For example, the fill module 100 may include a triangular support structure 150. FIG. 3 illustrates a side cross-sectional view of the fill module 100 taken along the plane designated by the corners 3 in FIG. 1, which shows the triangular support structure 150. The structure of the fill module 100 has been simplified in FIG. 3 for clarity. The fill module 100 may be loaded on a flatbed 200 of a truck. As shown in FIG. 3, a width of the flatbed 200 of the truck may be less than the width of the fill module 100. Accordingly, there is provided a triangular support structure 150 of the fill module 100 for supporting portions of the fill module 100 that overhang the flatbed 200 of the truck. These portions of the fill module 100 that overhang the flatbed 200 of the truck are examples of "overhang portions." The fill module 100 may be placed on the flatbed 200 of the truck such that a longitudinal length of the fill module 100 is parallel to the sides of the truck. The triangular support structure 150 may be disposed in a plane parallel to a transverse side of the fill module 100.

In other aspects, the fill module 100 may be transported on a surface (e.g., a flatbed) having a width that is equal to or greater than the width of the fill module 100. In such aspects, the entire base of the fill module 100 may be supported by the surface and therefore the fill module 100 may be transported without additional support for any overhang portions.

The triangular support structure 150 may be formed from a subset of the plurality of structural members of the structural system 120. As depicted in FIG. 3, the triangular support structure 150 may include structural members 210, 220, 230, 240. The structural member 240 may be located at a base of the fill module 100 and form a base of the triangular support structure 150. The structural member 210 may be connected to the structural member 240 and extend out perpendicularly towards the top of the fill module 100. The structural members 210, 240 may be compression members capable of withstanding compressive forces. The structural members 210, 240 may also be capable of withstanding tension forces. The structural members 210, 240 may be, for example, pultruded fiber reinforced polymer, concrete, metal beams, or the like.

The structural members 220, 230 may be diagonal structural members. As depicted in FIG. 3, the structural member 220 may be connected to a first end of the structural member 240 and a distal or top end of the structural member 210; and the structural member 230 may be connected to a second end of the structural member 240 and the distal end of the structural member 210. The structural members 220, 230 may be tension members capable of withstanding tension forces. The structural members 220, 230 may be, for example, a strap or a thin rod. Alternatively, the structural members 220, 230 may be tension/compression members that are also capable of withstanding compression forces.

When the fill module 100 is being transported and, specifically, when the fill module 100 is being transported on a surface (e.g. the flatbed 200) having a width less than the width of the fill module 100, the triangular support structure 150 may be capable of transferring a load from portions of the fill module 100 that overhang the surface (e.g., overhang portions) to a center portion of the fill module 100. More specifically, the structural members 220, 230 may carry or transfer loads from the respective ends of the structural member 240 to which they are connected to a top of distal end of the structural member 210. The structural member 210 then transfers the loads from its distal end to the center portion of the fill module 100. The center portion of the fill module 100 may be located at a center of the surface. Thus, the structural member 210 may transfer the loads to the center portion of the fill module 100 by delivering a compressive force downward towards the center of the surface. In such an arrangement, the structural member 210 is an example of a "king post."

Also, when the fill module 100 is being transported, the structural members 220, 230 may be in tension, and the structural members 210, 240 may be in compression. The structural member 220 may be in tension because the first end of the structural member 240 and the top end of the structural member 210 to which it is connected may pull the structural member 220 in different directions. In particular, the portions of the structural member 240 which cantilever over a surface of the flatbed 200 have a propensity to droop or deflect downward. Thus, in order to resist drooping, the diagonal structural members 220, 230 are placed in tension to induce upward components of force and inward horizontal components of force on the first end and the second end of the structural member 240. As such, the structural member 240 is in compression. In addition, the tensile forces in the structural members 220, 230 pull down on the structural member 210 (i.e., the king post), placing it in compression as well.

As depicted in FIG. 3, the triangular support structure 150 is also disposed below a structural member 250. The structural member 250 may be a compression member. The structural member 250 may form a top portion of the fill module 100. The structural member 210 and, specifically, the top end of the structural member 210, may be connected to the structural member 250. The structural member 250 may exert an additional load down onto the structural member 210 of the triangular support structure 150. Accordingly, the structural member 210 may also be configured to receive and transfer this additional load from the structural member 250 to the center portion of the fill module 100.

The triangular support structure 150 of the fill module 100 may be arranged in a symmetrical fashion as shown in FIG. 3. The structural member 210 may be connected to the structural member 240 at a halfway point between its two ends. And the structural members 220, 230 may be arranged symmetrically about the structural member 210. Thus, the triangular support structure 150 may be symmetrical along a central axis of the structural member 210.

Figure 4:
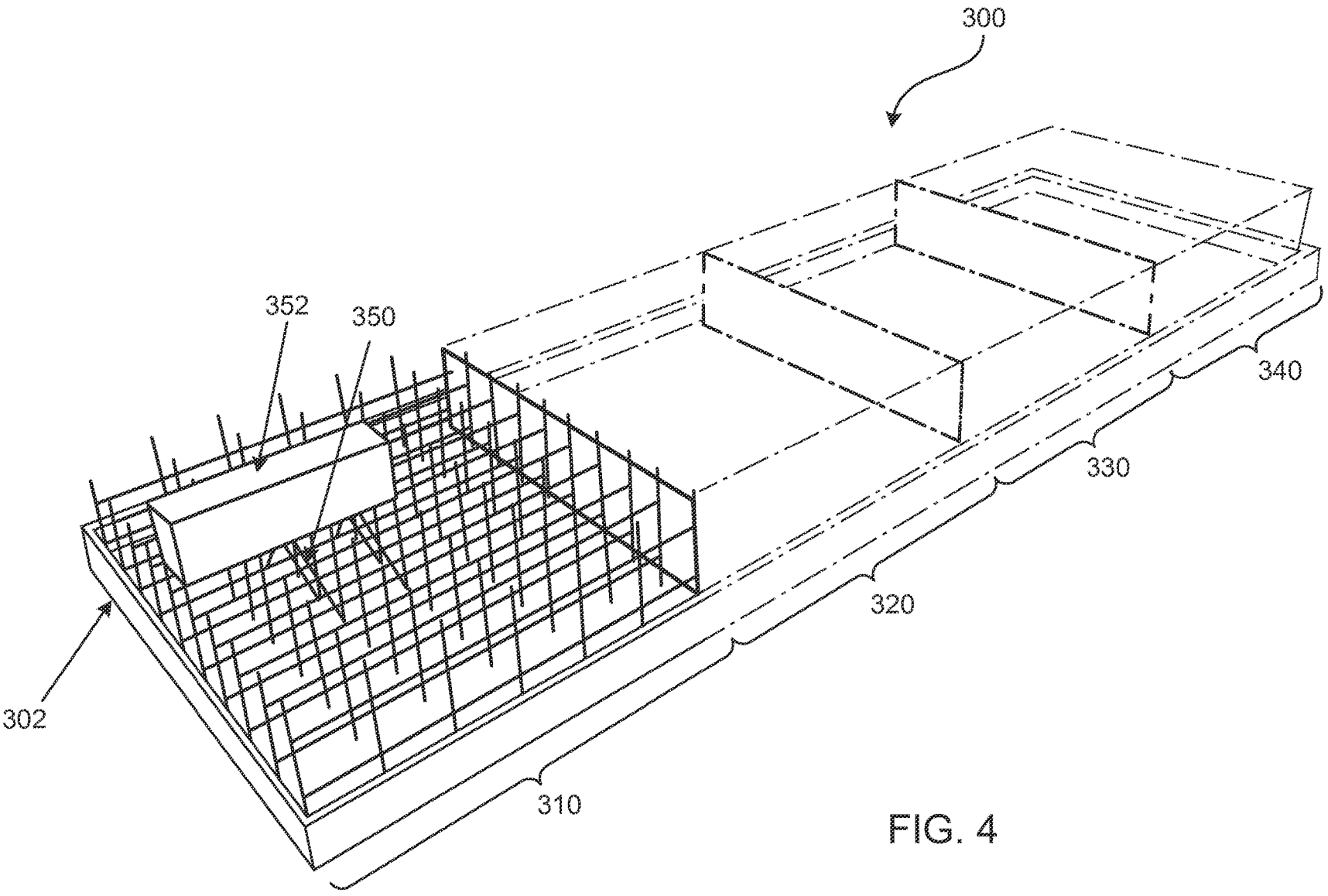
FIG. 4 is a schematic view of a cooling tower in a process of assembly in accordance with an embodiment of the present disclosure.

FIGS. 4 through 9 depict exemplary stages of assembly of a cooling tower 300 according to aspects of the present disclosure. In FIG. 4, a fill module 352 is being installed in the cooling tower 300. The cooling tower 300 may include a cold water basin 302 and a plurality of air inlet structures, including an air inlet structure 350. The cooling tower 300 may comprise four (4) cells—cells 310, 320, 330, 340. Each cell may comprise an individual cooling system, including an air inlet layer, a fill module layer, and a plenum module layer. While the cooling tower 300 described herein includes four (4) cells, one of ordinary skill in the art would appreciate that the methods disclosed herein may be used to construct cooling towers with less or more cells. Moreover, one of ordinary skill in the art would appreciate that a cooling tower according to the present disclosure may include block towers having any number of cells arranged transversely or longitudinally.

The cooling tower 300 is being assembled at a job site. The assembly may involve constructing the cold water basin 302 and assembling a layer of air inlet structures on the cold water basin 302. The cold water basin 302 may be formed of, for example, reinforced concrete. Assembly of the air inlet structures may include installing a series of transverse bents and diagonal members. Temporary structural (not shown) may be attached to the transverse bents to keep them upright until longitudinal bent framing is installed. To facilitate the installation of the fill modules, certain components of the air inlet structures—such as, for example, structural members disposed near the top of the air inlet structures—may be installed after the fill modules are installed.

As depicted in FIG. 4, a first fill module (e.g., fill module 352) may be placed on top of one of the many air inlet structures assembled on top of the cold water basin 302 or, specifically, the air inlet structure 350. Fill modules of the cooling tower 300, including the fill module 352, may be previously assembled off site (e.g., at a factory), placed on a carrier, and transported to the job site. When assembled, each fill module may include fill packing and a structural system, such as the fill module 100 (see FIG. 1). Certain fill modules (e.g., fill module 382 depicted in FIG. 6) may also include a firewall structure. A forklift machine may be used to lift the fill module 352 (and the other fill modules) and place it on top of the carrier. The fork of the forklift machine may be inserted below the base of the fill module 352 in order to lift it. The base of the fill module 352 may include a plurality of transverse structural members disposed below a plurality of longitudinal structural members, much like the fill module 100 depicted in FIG. 1. Accordingly, when the fork of the forklift machine is inserted below the base of the fill module 352, the tines of the fork are parallel to the transverse structural members and in contact with the longitudinal structural members.

When transported, the fill module 352 may be fastened or secured to the carrier using a fastening member such as the U-shaped bolt of the fill module 100. Alignment tubes (not depicted) may also be inserted into the fill module 352 to lock in place a position of the fill packing of the fill modules.

The fill modules may be assembled and delivered to the job site for just-in-time installation. Once at the job site, the fill modules may be hoisted from the carrier and placed on top of the air inlet structures. For example, in FIG. 4, the fill module 352 is placed on top of the air inlet structure 350. The fill module 352 may be coupled or connected to the air inlet structure 350 at a point along a length of a horizontal structural member of the fill module 352 (e.g., a longitudinal structural member or a transverse structural member at the base of the fill module 352). The fill module 352 may be coupled to the air inlet structure 350 using corbels (see FIG. 11).

Figure 5:
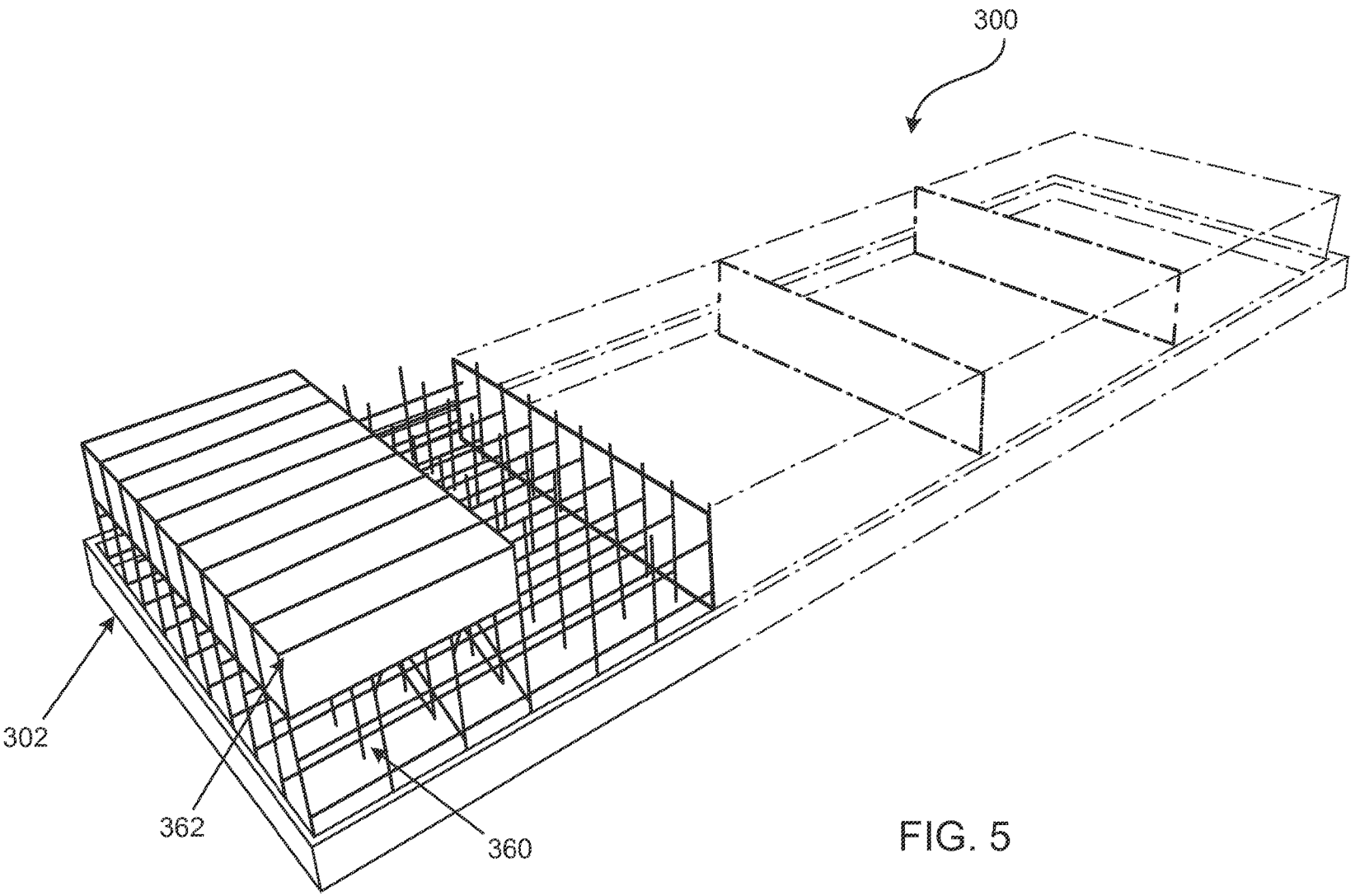
FIG. 5 is another schematic view of the cooling tower depicted in FIG. 4 in a process of assembly in accordance with an embodiment of the present disclosure.

In FIG. 5, additional fill modules, including the fill module 362, are placed on top of the air inlet structures, including air inlet structure 360. The additional fill modules may have the same dimensions or different dimensions from the fill module 362. For example, the fill module 362 may comprise two (2) bays (e.g., sections of adjacent transverse and longitudinal framing bents) whereas the fill module 352 may comprise one (1) bay.

Figure 6:
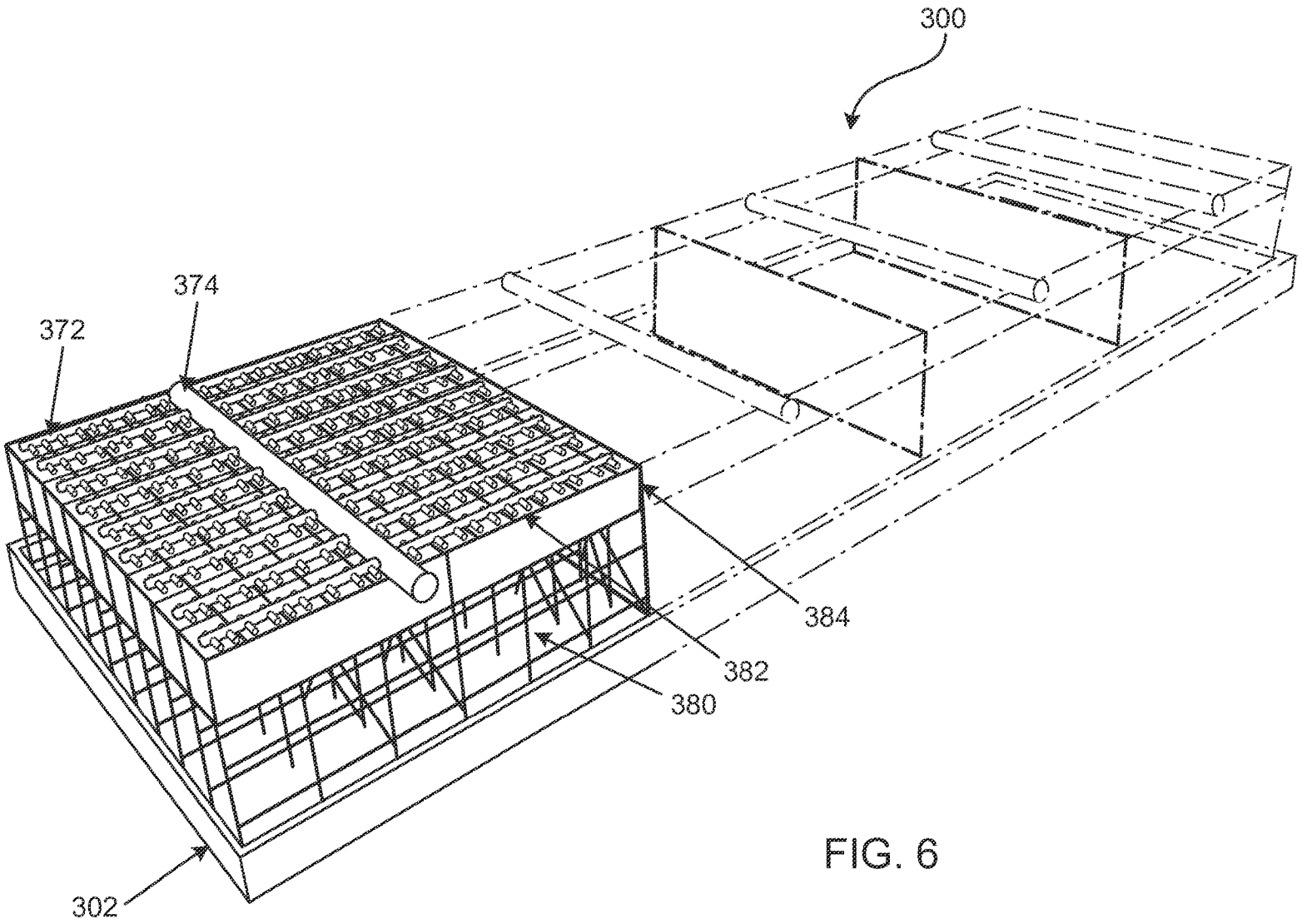
FIG. 6 is another schematic view of the cooling tower depicted in FIG. 4 in a process of assembly in accordance with an embodiment of the present disclosure.

The assembly of the cooling tower 300 may continue until the fill modules of the cooling tower 300 are all placed on the air inlet structures, as depicted in FIG. 6. When the fill modules are in place, fill modules including a firewall structure may form a portion of a firewall of the cooling tower 300. For example, in FIG. 6, a fill module 382 has been placed on top of an air inlet structure (e.g., air inlet structure 380). The fill module 382 may comprise a firewall 384, which forms a portion of the firewall of the cooling tower 300.

Also depicted in FIG. 6, a water delivery system (e.g., a pipe system) including header pipes (e.g., header pipe 374) and branch pipes (e.g., branch pipe 372) is assembled on top of the fill modules. The header pipes may receive liquid from exterior piping and deliver the liquid to the branch pipes, which have nozzles that distribute the water to the fill modules. Certain fill modules may include saddle structures that are configured to support the header pipes and/or the branch pipes of the cooling tower. The water delivery system may be assembled on top of the fill modules after the fill modules are placed on top of the air inlet structures.

Figure 7:
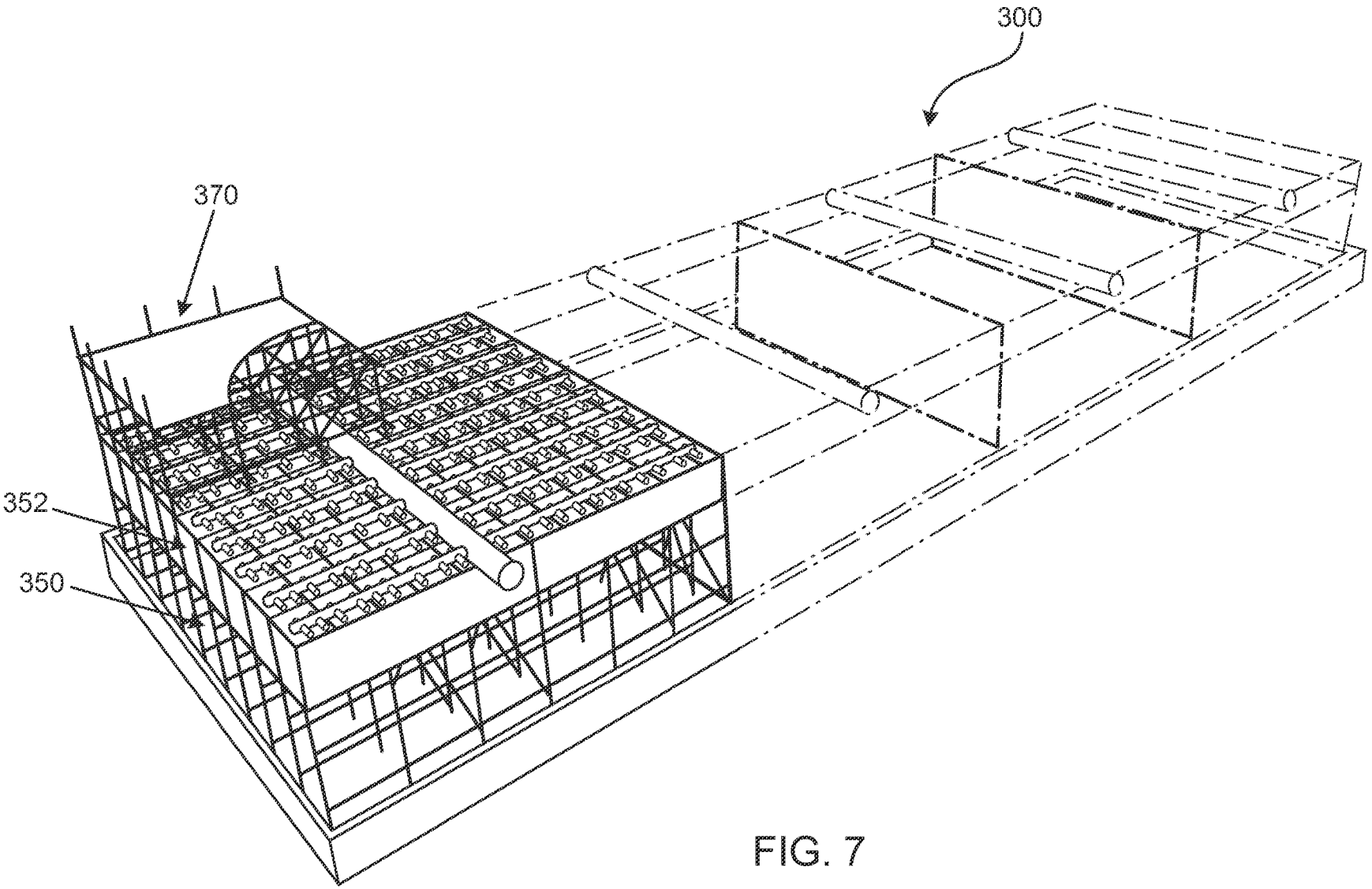
FIG. 7 is another schematic view of the cooling tower depicted in FIG. 4 in a process of assembly in accordance with an embodiment of the present disclosure.

In FIG. 7, a plenum module 370 is placed on top of a subset of the fill modules. The plenum module 370, similar to the fill module 352 and other fill modules, may be previously assembled off site (e.g., at a factory or a nearby yard). The plenum module may comprise a separate structural system from the fill module.

Figure 8:
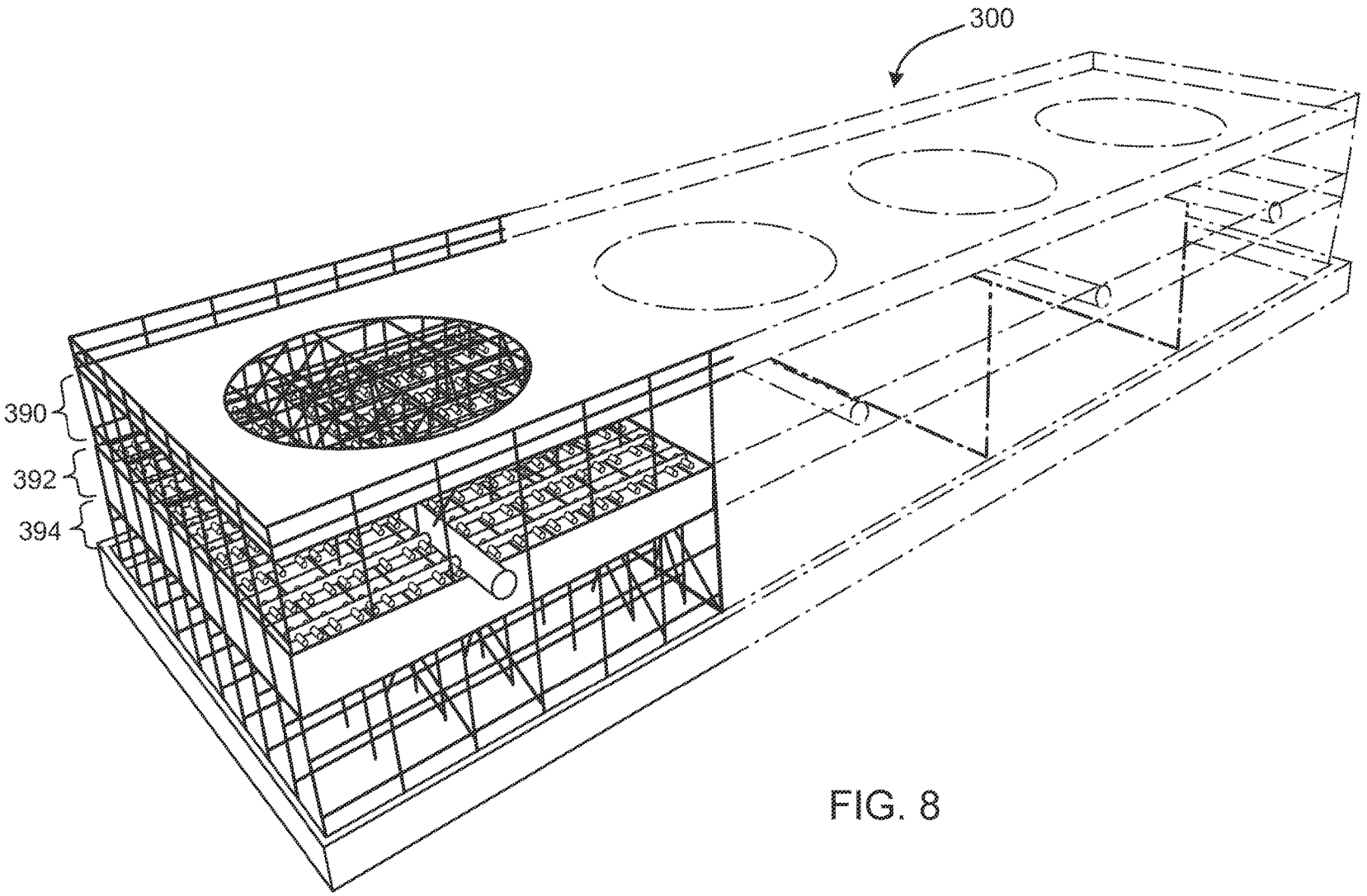
FIG. 8 is another schematic view of the cooling tower depicted in FIG. 4 in a process of assembly in accordance with an embodiment of the present disclosure.
Figure 9:
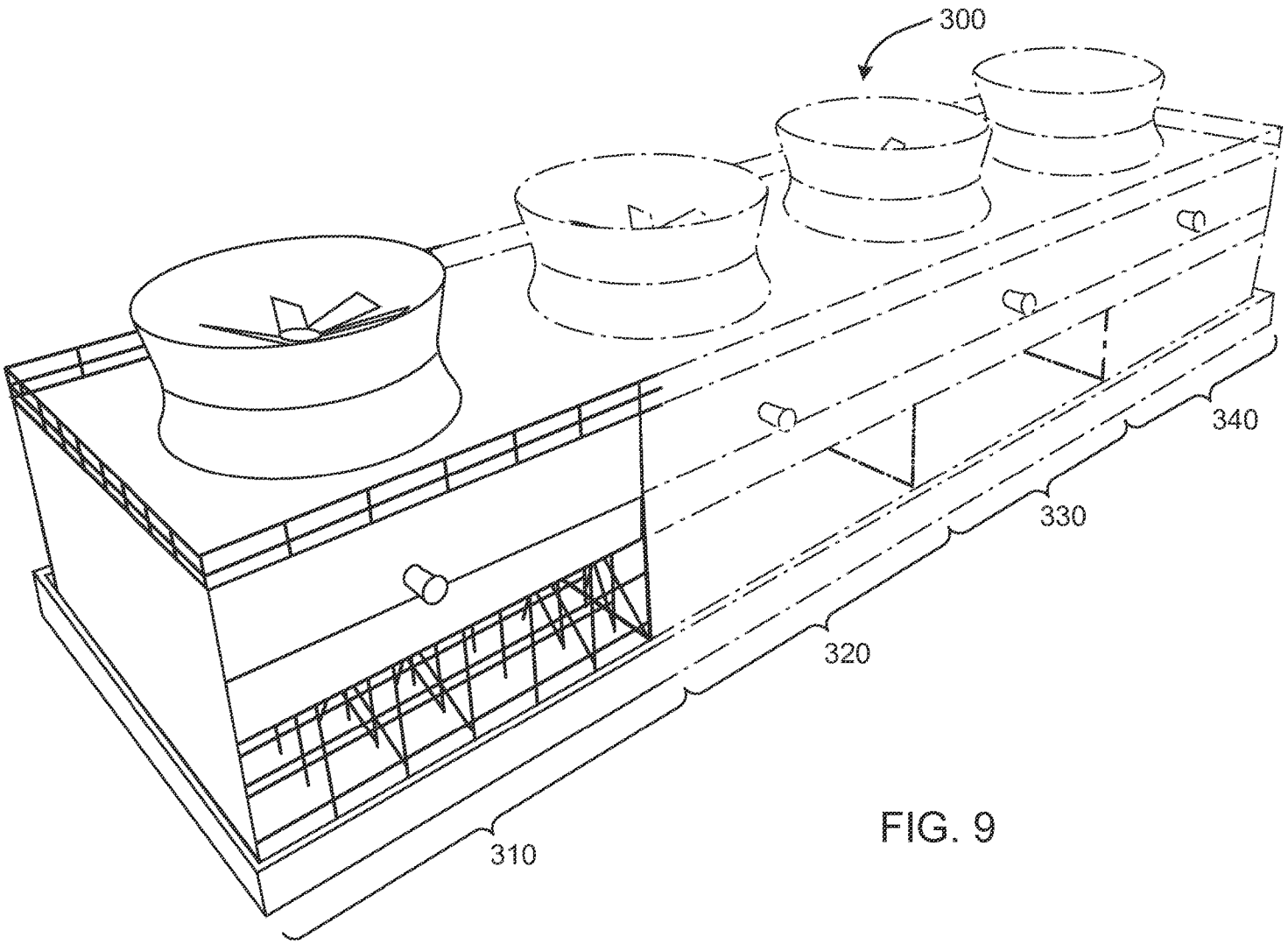
FIG. 9 is another schematic view of the cooling tower depicted in FIG. 4 in a process of assembly in accordance with an embodiment of the present disclosure.

FIG. 8 shows the assembly of the cooling tower 300 after all of the plenum modules, including plenum module 370, have been placed on the fill modules. As depicted in FIG. 8, the cooling tower 300 includes an air inlet structure layer 394, including the air inlet structures 350, 360, 380; a fill module layer 392, including the fill modules 352, 362, 382; and a plenum module layer 390, including the plenum module 370. FIG. 9 shows the cooling tower 300 fully assembled, including fan unit and outside casing. The outside casing may be attached to the sides of the cooling tower 300 to enclose certain tower components such as the fill modules and the plenum modules. In certain aspects, the outside casing may also close off the ends of the air inlet structures from air entry. Such a configuration may be referred to as a "closed end walls" configuration. Additional features (not depicted) may also be installed in the cooling tower 300 such as wind baffles, ladders, stairways, etc.

Figure 10:
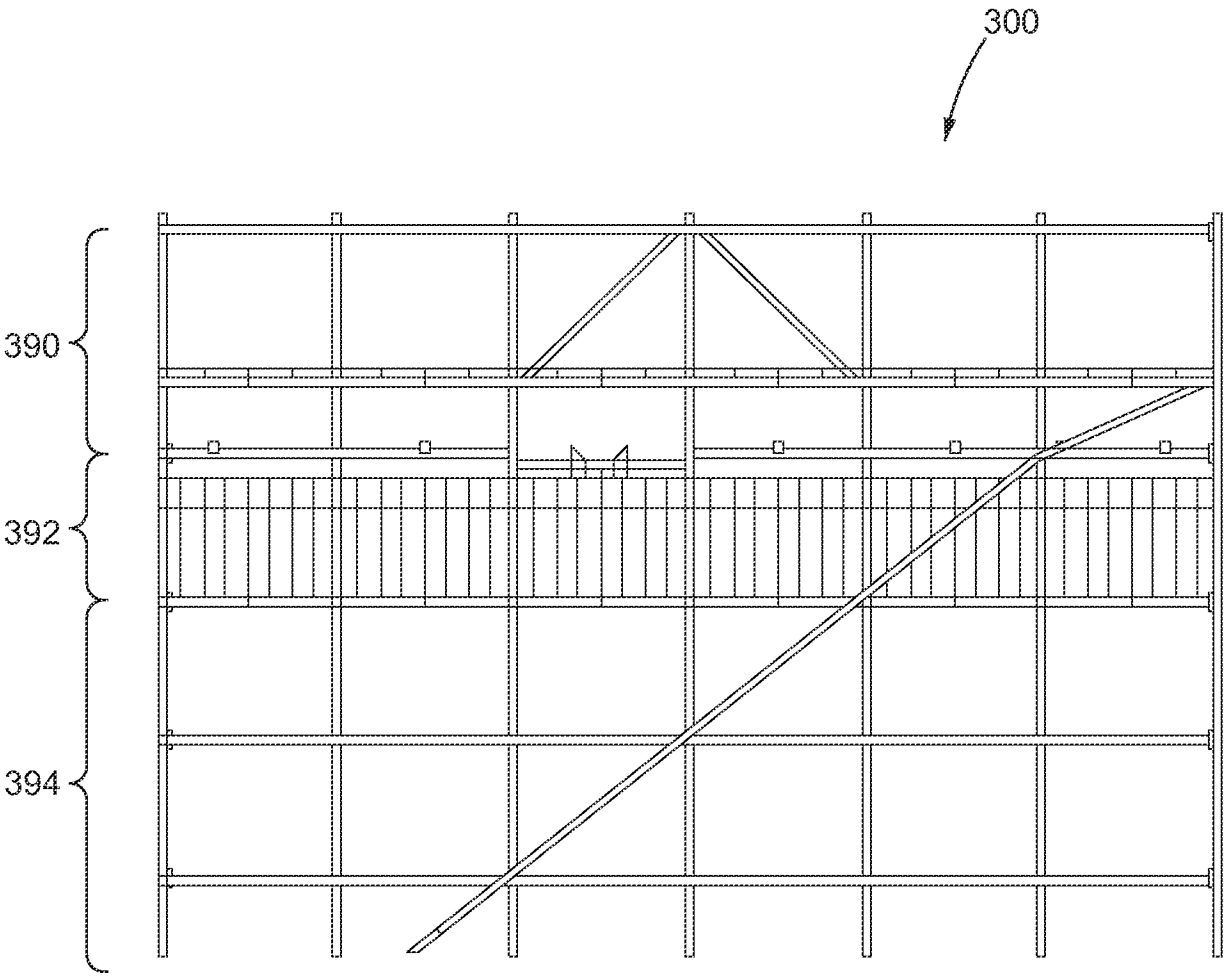
FIG. 10 is a cross-sectional view of a cell of the cooling tower depicted in FIG. 4 showing a support system of the cooling tower in accordance with an embodiment of the present disclosure.

When installed in the cooling tower 300, the structural system of the fill modules and the separate structural systems of the plenum modules may form a portion of the overall support system or "global structural system" of the cooling tower 300. Specifically, as depicted in FIG. 10, the structural systems of the fill modules may form a portion of the overall support system in the fill module layer 392 of the cooling tower 300, and the separate structural systems of the plenum modules may form a portion of the overall support system in the plenum module layer 390 of the cooling tower. The structural systems of the fill modules and the separate structural systems of the plenum modules, as well as the air inlet structure, may be designed to couple to one another and function together to provide overall or "global" support for the cooling tower.

Figure 11:
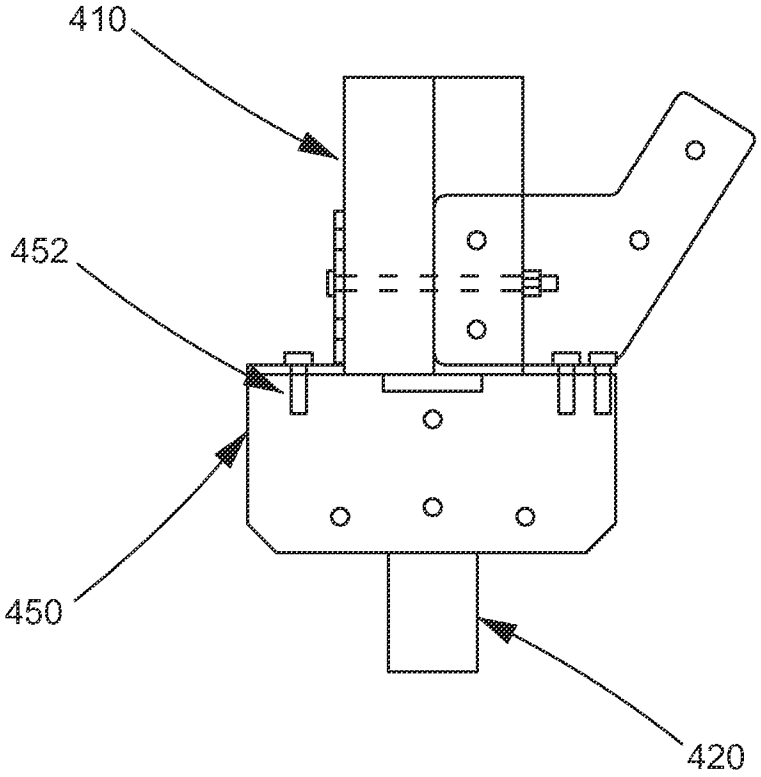
FIG. 11 is a schematic view of a fastening member of a cooling tower in accordance with an embodiment of the present disclosure.

FIG. 11 depicts a close-up view of a particular coupling point between a first structural member (e.g., structural member 410) and a second structural member (e.g., structural member 420). The structural member 410 may be a structural member of a fill module, and the structural member 420 may be a structural member of an air inlet structure. The structural members 410, 420 may be coupled to one another using a corbel 450 with alignment holes, including alignment hole 452, that are designed to align the structural members 410, 420 and to serve as connection points, when needed. Thus, once a bolt or other fastening member is inserted into the alignment holes of the corbel 450, the alignment holes not only connect the structural members 410, 420 but also align them to one another. The corbel 450 also has the capacity to accept diagonals (not shown) from the upper and/or the lower structures.

Referring now to FIG. 12, an exemplary firewall structure 500 according to aspects of the present disclosure is described. The firewall structure 500 may be installed in a fill module such as the fill module 100 depicted in FIG. 1. The firewall structure 500 may be configured to withstand dynamic loads when the fill module is transported without the need for extraordinary means of dynamic isolation such as, for example, a special transport for sensitive instrumentation or large computers. For example, the firewall structure 500 may be formed of a material that has sufficient tensile strength and flexural strength to withstand movements experienced by the fill module during transportation. Specifically, the firewall structure 500 may be formed of a fiber-reinforced material such as, for example, a fiberglass-reinforced polyester material or other fiberglass-reinforced polymer. The firewall structure 500, being formed of such material, may weigh less than a conventional firewall structure (e.g., a firewall structure formed of cement board) having the same dimensions. The firewall structure 500 may also have a flexural strength greater than conventional firewall structures having the same dimensions, and a tensile strength greater than conventional firewall structures having the same dimensions.

As depicted in FIG. 12, the firewall structure 500 may include a panel 510, a panel 520, and a separator 530. The panel 520 may be disposed spaced apart and parallel to the panel 510. The separator 530 may be a pultruded column tube, a channel shape, or other shape. As such, the separator 530 may have a rectangular cross-section, a channel shape, or other cross-section, in which a first side of the separator 530 is in substantial contact with an interior side of the panel 510 and a second side of the separator 530 is in substantial contact with an interior side of the panel 520. To provide added structural support, the separator 530 may extend fully across a length and/or breadth of the panels 510, 520 of the firewall structure 500.

The firewall structure 500 may comprise a non-porous surface that is substantially resistant to liquid absorption. As such, the firewall structure 500 may be less susceptible to freezing and thaw damage and biological growth. The water-resistant surface may also reduce product expansion and cracking.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, for example a forced draft air cooled condenser has been illustrated but an induced draft design can be adapted to gain the same benefits and, accordingly, all suitable modifications and equivalents may be resorted to that fall within the scope of the invention.

What is claimed is:

1. A method for assembling a cooling tower, the method comprising:

assembling a heat exchange module, the heat exchange module comprising fill packing and a structural system configured to provide compression and tension support for the cooling tower;

placing the heat exchange module when assembled on a carrier; and transporting the heat exchange module on the carrier to a site of the cooling tower, wherein the structural system is configured to provide compression and tension support for the fill packing during transportation of the heat exchange module, wherein the structural system comprises a triangular support structure, the triangular support structure configured to transfer a load from a base of the heat exchange module to a center portion of the heat exchange module.

2. The method of claim 1, wherein transferring a load from the base of the heat exchange module to the center portion of the heat exchange module comprises transferring a load from an overhang portion of the heat exchange module to the center portion of the heat exchange module, wherein the overhang portion corresponds to a portion of the heat exchange module overhanging a surface of the carrier on which the heat exchange module is placed for transportation.

3. The method of claim 1, wherein placing the heat exchange module when assembled on the carrier comprises:

inserting a fork of a forklift machine below a base of the heat exchange module;

lifting the heat exchange module using the forklift machine;

placing the heat exchange module on the carrier from a side of the carrier, wherein the base of the heat exchange module comprises a plurality of transverse structural members disposed below a plurality of longitudinal structural members;

wherein the fork is inserted below the base of the module parallel to the transverse structural members and in contact with the longitudinal structural members.

4. The method of claim 1, further comprising fastening the heat exchange module to the carrier for transporting to the site of the cooling tower using a fastening member.

5. The method of claim 4, wherein the fastening member comprises a U-shaped bolt.

6. The method of claim 1, further comprising inserting an alignment tube into the heat exchange module, wherein the alignment tube when inserted into the heat exchange module locks a position of the fill packing.

7. The method of claim 1, further comprising:

constructing a cold water basin at the site of the cooling tower;

assembling an air inlet structure on the cold water basin;

placing the heat exchange module on the air inlet structure; and coupling the heat exchange module to the air inlet structure.

8. The method of claim 1, wherein the heat exchange module is coupled to the air inlet structure at a point along a length of a horizontal structural member.

9. The method of claim 1, wherein the structural system of the heat exchange module is configured to form a portion of a support system of the cooling tower, wherein the support system of the cooling tower is configured to provide support to the cooling tower when the cooling tower is assembled.

10. The method of claim 9, further comprising:

assembling a plenum module, the plenum module comprising a different structural system; and placing the plenum module on top of the heat exchange module.

11. The method of claim 10, wherein the different structural system of the plenum module is configured to form a different portion of the support system of the cooling tower.

12. The method of claim 1, further comprising assembling a pipe system of the cooling tower, wherein the pipe system comprises a header pipe and a branching pipe, wherein the heat exchange module is configured to provide support for the pipe system.

13. The method of claim 12, wherein the pipe system is assembled on top of the heat exchange module after the heat exchange module is placed on top of the air inlet structure.

14. A method for assembling a cooling tower, the method comprising:

constructing a cold water basin;

assembling an air inlet structure on the cold water basin; and placing a heat exchange module on top of the air inlet structure, wherein the heat exchange module comprises fill packing and a structural system, wherein the heat exchange module is assembled prior to being placed on top of the air inlet structure, wherein the structural system is configured to provide compression and tension support for the fill packing when the heat exchange module is assembled and prior to the heat exchange module being placed on top of the air inlet structure, wherein the structural system comprises a triangular support structure, the triangular support structure configured to transfer a load from a base of the heat exchange module to a center portion of the heat exchange module.

15. The method of claim 14, wherein the structural system of the heat exchange module is configured to form a portion of a support system of the cooling tower, wherein the support system of the cooling tower is configured to provide support to the cooling tower when the cooling tower is assembled.

16. The method of claim 15, further comprising placing a plenum module on top of the heat exchange module, wherein the plenum module comprises a different structural system, wherein the plenum module is assembled prior to being placed on top of the heat exchange module, wherein the different structural system of the plenum module is configured to form a different portion of the support system of the cooling tower.

17. The method of claim 14, further comprising assembling a pipe system of the cooling tower, wherein the pipe system comprises a header pipe and a branching pipe, wherein the heat exchange module is configured to provide support for the pipe system.

18. The method of claim 17, wherein the pipe system is assembled on top of the heat exchange module after the heat exchange module is placed on top of the air inlet structure.

19. The method of claim 14, further comprising coupling the heat exchange module to the air inlet structure, wherein the heat exchange module is coupled to the air inlet structure at a point along a length of a horizontal structural member.

* * * * *